US008960067B2

(12) United States Patent
Schroeder

(10) Patent No.: US 8,960,067 B2
(45) Date of Patent: Feb. 24, 2015

(54) METHOD AND APPARATUS FOR LAUNCH RECOIL ABATEMENT

(71) Applicant: Lockheed Martin Corporation, Grand Prairie, TX (US)

(72) Inventor: Wayne K. Schroeder, Mansfield, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 13/739,854

(22) Filed: Jan. 11, 2013

(65) Prior Publication Data

US 2014/0076134 A1 Mar. 20, 2014

Related U.S. Application Data

(60) Provisional application No. 61/585,981, filed on Jan. 12, 2012.

(51) Int. Cl.

| | |
|---|---|
| ***F41F 3/04*** | (2006.01) |
| ***F41F 3/06*** | (2006.01) |
| ***F41A 1/08*** | (2006.01) |

(52) U.S. Cl.

CPC ..... *F41F 3/0413* (2013.01); *F41F 3/06* (2013.01); *F41A 1/08* (2013.01)

USPC ..... 89/1.816

(58) Field of Classification Search

USPC ..... 89/1.8–1.82, 14.3; 224/110 B

See application file for complete search history.

(56) References Cited

U.S. PATENT DOCUMENTS

| | | | | |
|---|---|---|---|---|
| 2,802,399 | A * | 8/1957 | Little | 89/1.816 |
| 2,998,754 | A * | 9/1961 | Bialy | 89/1.816 |
| 3,228,294 | A * | 1/1966 | Hickman | 89/1.8 |
| 3,628,415 | A * | 12/1971 | McElroy | 89/14.05 |
| 5,012,718 | A * | 5/1991 | Miller | 89/1.816 |
| 5,194,688 | A * | 3/1993 | Piesik | 89/1.816 |
| 5,837,919 | A * | 11/1998 | Yagla et al. | 89/1.816 |
| 6,584,882 | B2 * | 7/2003 | Briggs et al. | 89/1.817 |
| 6,971,300 | B2 * | 12/2005 | Kunstmann | 89/1.816 |

* cited by examiner

*Primary Examiner* — Bret Hayes

(74) *Attorney, Agent, or Firm* — Terry M. Sanks, Esq.; Beusse Wolter Sanks & Maire, P.A.

(57) ABSTRACT

Recoil forces of a launched missile and the moment force imposed on the launch platform can be reduced by use of a recoil abatement element in communication with a launch tube. The recoil abatement element includes at least one nozzle configured to receive therethrough exhaust gasses from a missile when launched. The nozzle can be canted or otherwise configured to direct the exhaust gasses in a desired direction to thereby offset moment force imposed on the platform by the exhaust gasses.

20 Claims, 2 Drawing Sheets

METHOD AND APPARATUS FOR LAUNCH RECOIL ABATEMENT

RELATED CASE

This application claims priority to U.S. Provisional Patent Application No. 61/585,981 filed on Jan. 12, 2012, and entitled "Method and Apparatus for Launch Recoil Abatement," which application is incorporated herein by reference.

BACKGROUND

Unmanned aerial vehicles (UAVs) are becoming increasingly effective in a host of applications, including the delivery of missiles and/or other devices that could be launched from an UAV. Typically, however, UAVs are relatively small and lightweight. As such, the force imposed upon a UAV as a result of launching a missile therefrom imposes a significant moment on the UAV. The resulting motion could result in loss of target track, loss of illumination capability, flight instabilities, and the like.

One conventional approach to ameliorating the effects of launch forces is to use a mechanical counter-weight to offset the forces. Such an approach is disadvantageous, however, as it may significantly increase the weight of the UAV, perhaps to the point where the UAV would either be inoperable, or unable to carry the desired payload and supporting equipment.

BRIEF DESCRIPTION OF THE DRAWINGS

For a more complete understanding of the present embodiments, and the advantages thereof, reference is now made to the following descriptions taken in conjunction with the accompanying drawings, in which.

DETAILED DESCRIPTION OF ILLUSTRATIVE EMBODIMENTS

The making and using of the present embodiments are discussed in detail below. It should be appreciated, however, that the present disclosure provides many applicable inventive concepts that can be embodied in a wide variety of specific contexts. The specific embodiments discussed are merely illustrative of specific ways to make and use the disclosed subject matter, and do not limit the scope of the different embodiments.

Embodiments will be described with respect to a specific context, namely a launch recoil abatement apparatus for use on an unmanned aerial vehicle (UAV) carrying an in-flight launched missile.

Figure 1A:
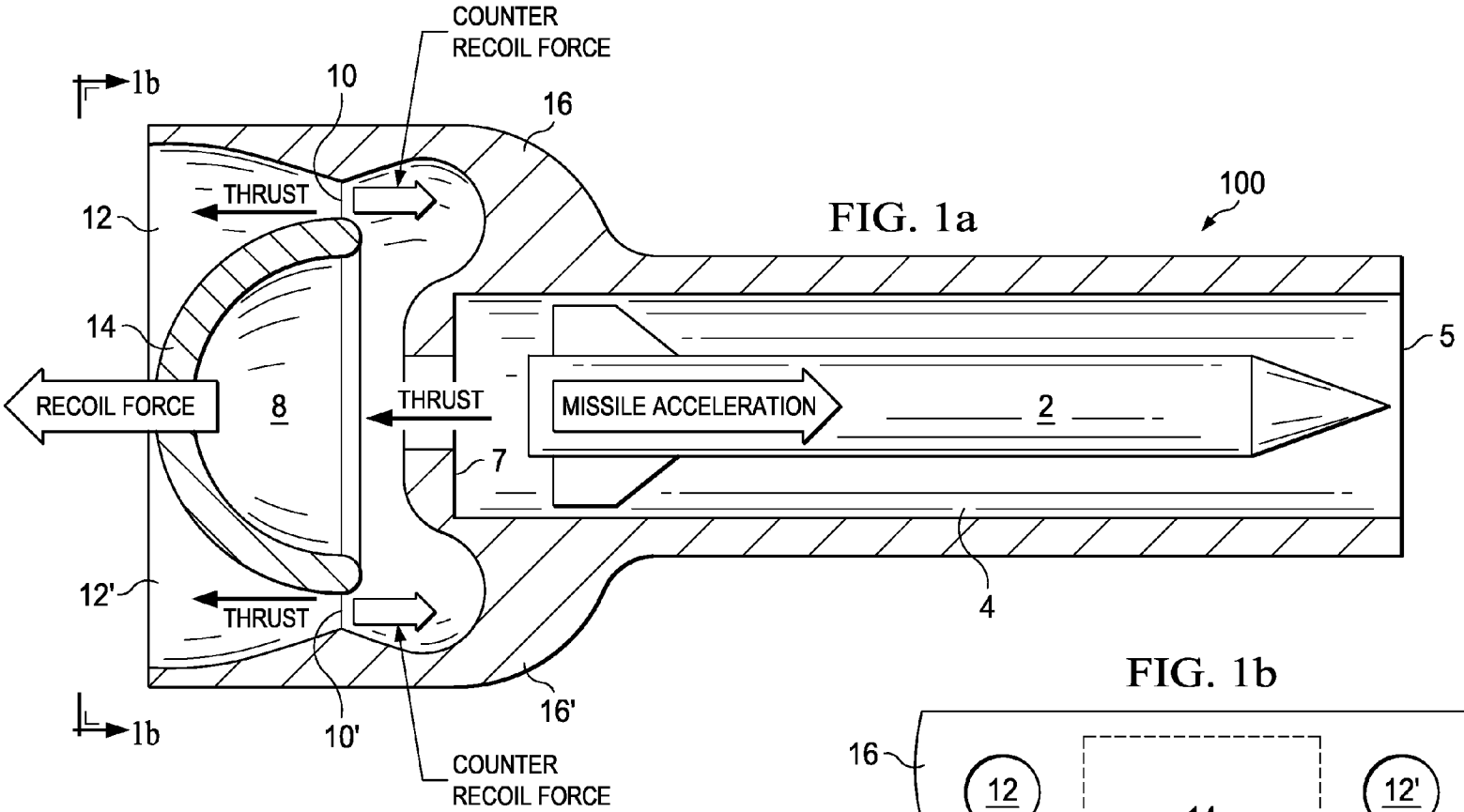
FIGS. 1*a* and 1*b* illustrate in cross section an embodiment apparatus for launch recoil abatement.

With reference now to FIG. 1*a*, there is shown in cross sectional view, a launch recoil abatement system 100 in which is contained a missile 2. Missile 2 is contained within a launch tube 4, a first end 5 of which is open to allow for egress of missile 2 upon launch. Back end 7 of launch tube 4 opens to cavity 8, which in turn feeds to nozzles 12 and 12', which include respectively throats 10 and 10'. Cavity 8 is defined by center element 14 and side elements 16 and 16'. Missile 2 could be, e.g., a solid rocket motor propelled missile, for instance.

Figure 1B:
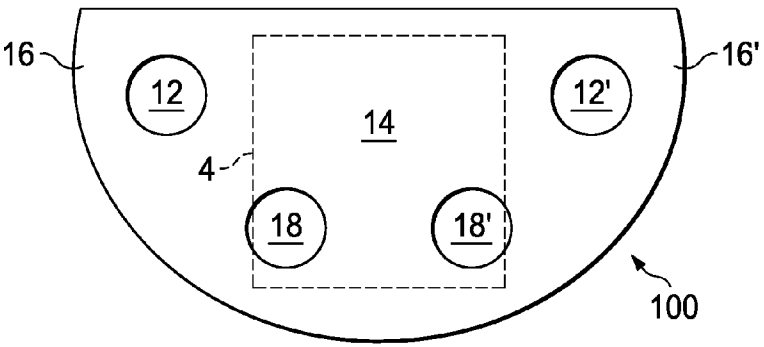

FIG. 1*b* illustrates an elevation view of launch recoil abatement system 100 when viewed in the direction indicated by arrow 1*b* of FIG. 1*a*. This view would be the portion of launch recoil abatement system 100 that would face the rear of, e.g., a manned or unmanned aircraft, a mounting platform for a land-based or sea-based launch platform, or even a hand-held or ground-positioned launch platform.

Upon launch of missile 2, a recoil force is imposed upon launch system 100 (and upon, e.g., aircraft, tripod, etc. to which launch system 100 is attached). By forcing the propellant and launch gases ejected from the back of missile 2 during launch through nozzles 12, 12', a counter recoil force is established that offsets the recoil force imposed upon the platform.

While four nozzles (12, 12', 18, and 18') are shown in FIGS. 1*a* and 1*b*, one skilled in the art will recognize that any number of nozzles could be employed, depending upon the particular application involved. In another embodiment, an annular exhaust nozzle could be used having a circumference of nearly 360 degrees, rather than several discrete nozzles, such as illustrated. Of course, accommodation must be made for structural support for forming center element 14.

By the use of directing propellant and exhaust gases through one or more nozzles, the amount of recoil force imposed on launch system 100 and the platform to which it is attached can be reduced.

Figure 2A:
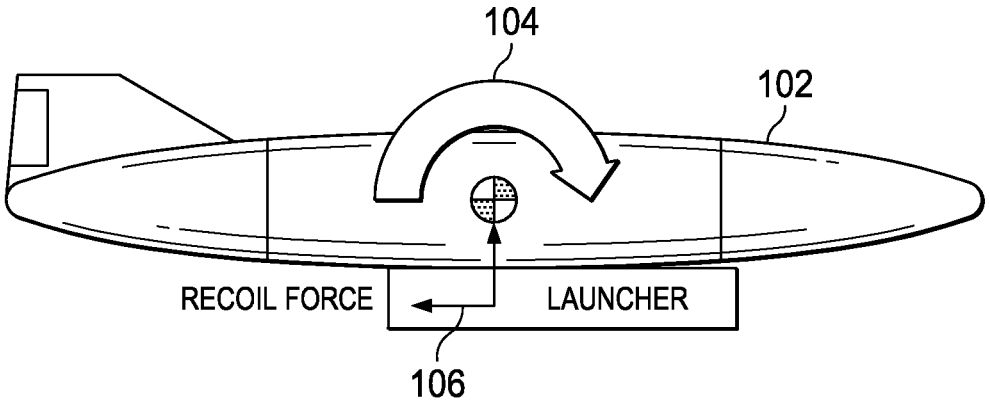
FIGS. 2*a* and 2*b* illustrate the improvement in applied moment on an aircraft with an embodiment launch recoil abatement apparatus, relative to an aircraft not having the launch recoil abatement apparatus.

Another consequence of the recoil from launching missile 2 is that the recoil force imposes a moment force on the platform. This is illustrated in FIG. 2*a*. Because the launch system will typically be offset from the central axis of the platform (such as mounted beneath the fuselage or beneath a wing), the recoil force causes torque or a moment force to be applied to the platform. This moment force can cause undesirable pitch, yaw, and/or roll (depending upon where the launch system is mounted) to the platform. FIG. 2*a* illustrates this phenomenon. As shown, an aircraft 102 experiences undesirable pitch (indicated by arrow 104) as a result of the recoil force (indicated by arrow 106) generated by the launch of a missile.

Figure 2B:
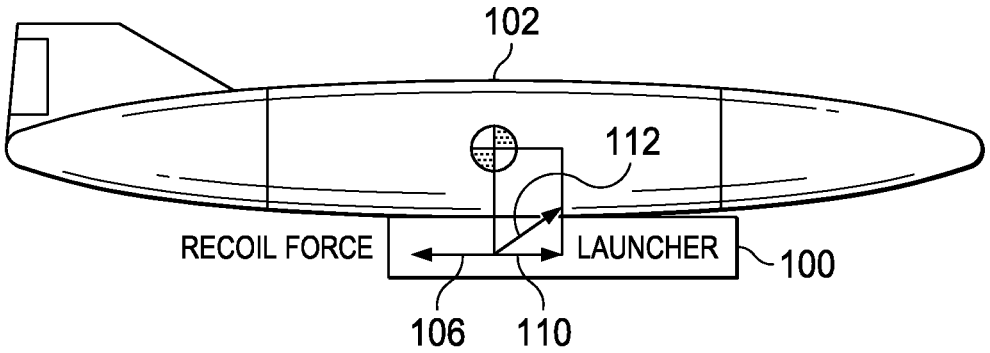

FIG. 2*b* illustrates an application for an exemplary system, such as launch recoil abatement system 100. In the illustrated embodiment a launch recoil abatement system, such as system 100 illustrated in FIGS. 1*a* and 1*b*, is attached to aircraft 102. In this case, a counter recoil force (indicated by vector arrow 112) is generated by forcing propellants and exhaust gas at a canted angle relative to the exhaust generated from a missile traveling in launch tube 100. This counter recoil force 112 has components along the axis of the applied recoil force 106 and perpendicular to the applied recoil force, each component contributing to producing a counter moment (or torque) that eliminates or reduces the moment present 104 that would exist without the recoil abatement system. The net effect of countervailing forces 106 and 110 is less recoil force imposed on the aircraft and reduced or eliminated recoil moment 104 which would tend to rotate the aircraft 102 in a clockwise direction.

In some embodiments, it is desirable to design launch system 100 such that exhaust gasses at the point of throats 10, 10' is about Mach 1. This allows for supersonic speeds as the exhaust gas exits nozzles 12, 12', respectively.

FIG. 2*b* illustrates another advantageous feature of some embodiment launch systems. By canting nozzle 12, the direction of counter recoil force 110 can be controlled to counteract the amount of moment 104 being applied to aircraft 102. For instance, in the example illustrated in FIG. 2*a*, the launch of missile 2 causes a clockwise moment force 104 on aircraft 102, which would cause pitch in the clockwise direction. By canting nozzles 12 downward, for instance, a countervailing counterclockwise moment can be created to offset or perhaps eliminate entirely this clockwise moment, the reducing or eliminating undesirable pitch. One skilled in the art will recognize that various directional orientations can be employed to offset moment forces on the aircraft. Canting a nozzle, orienting a nozzle, deflecting flow from a nozzle, and similar approaches will be apparent modifications to those skilled in the art to achieve this advantageous feature.

Another advantageous feature of the illustrated embodiments is that center element 14, in addition to contributing to the formation of cavity 8, can operate to prevent ejection of solid objects from the back end of launch system 100. As an example, some missiles 2 are configured with an igniter that is placed at the back end of the missile. At launch, this igniter may be expelled from missile 2 with great force and velocity. In some applications, it is undesirable to have an igniter or other matter being expelled in this manner. Center element 14 may operate as a containment or retaining element by, in effect, capturing or at least deflecting any solid material ejected from the back of missile 2 or launch tube 4 during launch.

Side elements 16, 16', center element 14, and other components of launch system 100 may be constructed using known processes and materials such as steel, aluminum, composite materials, ceramics, and the like. Light weight is a desirable quality of the material, as is the ability to withstand the launch environment (high temperatures, high forces, and the like).

In some embodiments, additional features may be realized, such a system configured to counter in direction the total applied moment on vehicle. The counter-recoil force may be, but does not have to be, equal and opposite the Induced Recoil Force. While several nozzles were illustrated, a single direct nozzle could be employed. In some embodiments, back pressure may be vented away from the missile. While a single nozzle is contemplated, it is noted that multiple nozzles allow greater expansion ratio in a limited package geometry (increases potential thrust and therefore recoil recovery). Additionally, multiple canted nozzles allow greater a degree of freedom to negate/reduce total recoil moment on launching platform.

Embodiments of the invention allow for significantly reducing the launch forces and moments imposed on a launch platform by a propulsion propelled vehicle (missile) by damping the recoil forces in a unique manner. The novel approach does not use mechanical mass damping and is therefore conducive to a light weight launcher approach. It utilizes the pressurized flow field exhausted by the missile and redirected in a novel manner to dampen the forces (and moment) imposed on the launch vehicle. The invention is able to be configured to apply moment counter to the applied moments considering the placement on the launch aircraft. (In other words, beyond countering the applied moments, the counter forces can be applied with direction).

Some embodiments allow one to vector the exhaust thrust of the launching missile in a direction to counter the direct recoil forces from the missile. The apparatus may be monolithic structure that redirects the exhaust flow through additional nozzles to accelerate the flow, creating additional thrust to counter the recoil, but in a desired direction.

Although the present embodiments and their advantages have been described in detail, it should be understood that various changes, substitutions and alterations can be made herein without departing from the spirit and scope of the disclosure.

Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed:

1. A device for reducing recoil forces of a launched missile comprising:

a missile launch tube with a first end for egress of the missile upon launch and a back end with an opening through which exhaust gasses exit the launch tube during egress; and a recoil abatement element in communication with the launch tube through the opening of the back end of the missile launch tube with communication occurring with the opening located at a front end of the recoil abatement element, the recoil abatement element including a cavity defined in part by an arcuate center element located at a back end of the recoil abatement element and a side element, at least one nozzle configured to provide egress for exhaust gasses from within the recoil abatement element, the at least one nozzle, formed with a throat defined by the arcuate center element and the side element, configured to direct exhaust gasses out of the recoil abatement element in a direction opposite the first end of the missile launch tube;

wherein the recoil abatement element provides for exhaust gasses leaving the missile to be directed to the at least one nozzle by the arcuate center ent and the side element resulting in counter recoil forces and centralizing of the recoil forces of the launched missile and the counter recoil forces at the back end of the missile launch tube.

2. The device of claim 1 wherein the nozzle is configured to direct exhaust gasses in a desired direction.

3. The device of claim 1 further in including a surface for attaching to a platform, wherein the platform is an aircraft, a landcraft, a watercraft, or a ground positioned platform.

4. The device of claim 1 wherein the nozzle includes at least four nozzles.

5. The device of claim 1 wherein the nozzle is a continuous or nearly continuous opening of 360 degrees circumference.

6. The device of claim 1 wherein the recoil abatement element is formed at least in part of a material selected from the group consisting essentially of aluminum, steel, a composite material, and ceramic.

7. The device of claim 1 wherein the throat is configured to restrict flow of gasses passing through the throat.

8. The device of claim 7 wherein the device is configured such that gasses pass through the throat at a velocity of about Mach 1.

9. The system of claim 1 wherein the side element comprises an arcuate portion configured to direct exhaust gasses from the arcuate center element to the nozzle.

10. A method of launching a missile comprising:

receiving exhaust gasses from the missile in a cavity of a missile launch tube, the cavity defined in part by an arcuate center element located at a back end of the missile launch tube and a side element;

directing the exhaust gasses to a nozzle at a back end of the launch tube opposite to a first end of the launch tube for egress of the missile, the nozzle formed between the arcuate center element and the side element, the side element distinct from the missile launch tube; and directing the exhaust gasses out the back end of the launch tube through the nozzle, and in combination with the cavity, to establish a counter recoil force and to centralize a recoil force of launching the missile and the counter recoil force at the back end of the launch tube.

11. The method of claim 10 wherein, the step of directing the exhaust gasses through the nozzle offsets a recoil force imposed upon a platform from which the missile is launched.

12. The system of claim 1 wherein the side element comprises an arcuate portion configured to direct exhaust gasses within the cavity to the throat.

13. The method of claim 10 further including re-directing the flow of the exhaust gasses to offset a moment force imposed upon a platform from which the missile is launched.

14. The method of claim 13 wherein the step of re-directing is realized by passing the exhaust gasses through at least one canted nozzle.

15. A system for launching a missile comprising:

a launch platform;

a launch recoil abatement system attached to the platform, and including:

a launch tube configured to receive therein the missile, said launch tube including a first end for egress of the missile upon launch and a back end with an opening through which exhaust gasses exit the launch tube during egress of the missile;

a cavity defined hart by an arcuate center element located at a back end of the launch tube and a side element, at least one nozzle configured to provide egress for exhaust gasses from within the cavity;

the at least one nozzle in communication with the cavity and positioned at the back end of the launch recoil abatement system opposite to the first end of the launch tube, said nozzle configured to pass therethrough gasses expelled by a missile into the cavity to establish a counter recoil force and to centralize a recoil force from launching the missile and the counter recoil force at the back end of the launch tube.

16. The system of claim 15 further comprising a plurality of nozzles.

17. The system of claim 15 wherein the arcuate center element is further configured to contain solid objects ejected from a missile during launch.

18. The system of claim 15 wherein the nozzle is oriented in a selective direction such that the counter recoil force is configured to generate a first moment on the platform in a first direction to offset a second moment generated by the recoil force on the platform in a second direction opposite to the first direction.

19. The system of claim 15 wherein the side element comprises an arcuate portion configured to direct exhaust gasses from the arcuate center element to the throat.

20. The system of claim 15 wherein the side element comprises an arcuate portion configured to direct exhaust gasses within the cavity to the nozzle.

* * * * *

UNITED STATES PATENT AND TRADEMARK OFFICE

CERTIFICATE OF CORRECTION

PATENT NO. : 8,960,067 B2
APPLICATION NO. : 13/739854
DATED : February 24, 2015
INVENTOR(S) : Wayne K. Schroeder It is certified that error appears in the above-identified patent and that said Letters Patent is hereby corrected as shown below:

In the Claims

Column 4, claim 1, line 38, delete “ent” and insert --element--.

Column 6, claim 15, line 1, delete “hart” and insert --in part--.

Signed and Sealed this
Twenty-sixth Day of May, 2015

Michelle K. Lee

Michelle K. Lee
*Director of the United States Patent and Trademark Office*